US005250767A

United States Patent [19]

Sammon

[11] Patent Number: 5,250,767

[45] Date of Patent: Oct. 5, 1993

[54] TELEVISION RECEIVER SIGNAL BLOCKING SYSTEM

[75] Inventor: Michael D. Sammon, Warwick, N.Y.

[73] Assignee: Vectron, Inc., Warwick, N.Y.

[21] Appl. No.: 685,755

[22] Filed: Apr. 16, 1991

[51] Int. Cl.[5] ..... H01H 27/06

[52] U.S. Cl. ..... 200/43.08; 200/43.11; 200/322; 70/168; 70/277; 358/349

[58] Field of Search ..... 200/43.01, 43.08, 43.11, 200/564, 570, 571, 321, 322, 504, 43.9; 70/167, 168, 169, 277, DIG. 30, 57, 58; 174/50, 66; 439/133, 304; 340/815.12, 815.13, 815.14; 358/245, 349; 455/4.2, 26.1

[56] References Cited

U.S. PATENT DOCUMENTS

| | | | |
|---|---|---|---|
| 2,777,023 | 1/1957 | Sepulveda | 200/564 X |
| 2,795,663 | 6/1957 | Estes | 200/43.21 |
| 2,856,474 | 10/1958 | Norris | 200/43.11 |
| 3,812,279 | 5/1974 | Voegeli | 220/210 X |
| 3,940,584 | 2/1976 | Cauldwell | 200/504 |
| 4,107,484 | 8/1978 | Petersen, III | 200/43.04 |
| 4,276,562 | 6/1981 | Stewart et al. | 455/4.2 |
| 4,323,762 | 4/1982 | Ervin et al. | 200/43.02 X |
| 4,479,688 | 10/1984 | Jennings | 200/43.02 |
| 4,550,341 | 10/1985 | Naito | 358/349 |
| 4,558,193 | 12/1985 | Test | 200/43.08 |
| 4,584,856 | 4/1986 | Petersdorff et al. | 70/167 X |
| 4,593,541 | 6/1986 | Hollis | 70/57 |
| 4,639,562 | 1/1987 | Fredrickson | 200/43.08 |
| 4,647,735 | 3/1987 | Siches | 200/43.08 |
| 4,718,107 | 1/1988 | Hayes | 455/26.1 |
| 4,898,009 | 2/1990 | Lakoski et al. | 70/58 |
| 4,975,550 | 12/1990 | Parchisin | 200/43.01 X |
| 4,980,524 | 12/1990 | Braun | 200/43.08 |
| 5,061,199 | 10/1991 | McClead | 200/43.08 X |
| 5,070,219 | 12/1991 | Grosskrueger et al. | 200/303 X |

FOREIGN PATENT DOCUMENTS

| | | | |
|---|---|---|---|
| 2208454 | 3/1989 | United Kingdom | 200/43.19 |

*Primary Examiner*—Henry J. Recla
*Assistant Examiner*—Glenn T. Barrett
*Attorney, Agent, or Firm*—Diller, Ramik & Wight

[57] ABSTRACT

A television receiver signal blocking system is provided which includes a television receiver, a television signal source and a television signal blocking mechanism therebetween. The television signal blocking mechanism includes a box from which electrical conductors are connected to the television receiver in a signal source, such as a television cable. Within the television signal blocking mechanism or box is a rotatable matching member which includes a latching arm and a switch carrying arm. The latching member is rotatable between three positions which permit the television signal blocking box to be opened to gain access to its interior while cutting off or blocking the signal; a second position in which the box is latched closed and the signal is not blocked; and a third position in which the box is closed and the signal is blocked.

19 Claims, 3 Drawing Sheets

TELEVISION RECEIVER SIGNAL BLOCKING SYSTEM

BACKGROUND OF THE INVENTION

Parents, educators and others accept as fact that children spend entirely too much time in front of a television receiver or television set, and much of this time is uncontrolled as to length and/or format. Parents admonish children to —"Do you homework first and then you may watch TV!"—, but generally to no avail. Obviously, when parents are not at home the use of television by children is totally uncontrolled and, more than likely, children do little else other than "vegetate" in front of the television set. Recognizing the latter, parents have utilized a variety of different approaches in an effort to prevent unmonitored/unauthorized/uncontrolled access to the television. For example, it is not uncommon for parents to throw the circuit breaker which controls the outlet to which the television set is connected. However, children are sufficiently intelligent to "throw" the circuit breaker back to its power on position or simply run an extension cord to a "hot" outlet.

DESCRIPTION OF RELATED ART

A search of the prior art incident to the preparation of the patent application for the present invention developed U.S. Pat. No. 2,856,474 in the name of Willard I. Norris which granted on Oct. 14, 1958. This patent discloses a key-controlled switch box which is used in the electric supply circuit for an appliance, such as a television set or a radio. However, the switch box is relatively dangerous because it is electrically connected between the household electrical power source and the television receiver. Thus, should a child attempt to tamper with the switch box when in its "off" position, such a child is subject to the inherent dangers of electrical shock.

Another electrical receptacle lock which is also designed to prevent appliances from being operated from a conventional wall outlet by unauthorized persons is disclosed in U.S. Pat. No. 4,167,658 granted Sep. 11, 1979 in the name of Robert S. Sheram. However, this appliance lock or receptacle lock is likewise subject to the danger of electrical shock because of its location in the electrical conductor between a conventional wall outlet and an associated appliance.

Other patents found during the latter-noted novelty search include the following:

| | | |
|---|---|---|
| Fairchild | Patent No. 340,868 | April 27, 1886 |
| Barnes | Patent No. 1,291,722 | January 21, 1919 |
| Wood | Patent No. 2,075,256 | March 30, 1937 |
| Blonder | Patent No. 3,129,992 | April 21, 1964 |
| O'Keefe | Patent No. 3,573,702 | April 6, 1971 |
| Ross et al. | Patent No. 3,760,130 | September 18, 1973 |
| Boegeli | Patent No. 3,812,279 | May 21, 1974 |
| Leone | Patent No. 3,844,779 | September 3, 1974 |
| Horan | Patent No. 3,861,770 | January 21, 1975 |
| Petersen | Patent No. 4,107,484 | August 15, 1978 |
| Iwaoka et al. | Patent No. 4,149,158 | April 10, 1979 |
| Ackerman | Patent No. 4,469,386 | September 4, 1984 |
| Martin | Patent No. 4,689,456 | August 25, 1987 |
| Parrish | Patent No. 4,767,895 | August 30, 1988 |

SUMMARY OF THE INVENTION

The present invention is a television receiver signal blocking system which is associated with a conventional television receiver. The television receiver signal blocking system includes a signal blocking box in which are located first and second electrical contacts normally in electrical insulated relationship to each other. A first electrical conductor associated with a television signal source is connected to the first electrical contact. A second electrical conductor is connected to the second electrical contact and to a television signal input terminal of the television receiver. A switch is selectively operable between first and second positions in which the first and second electrical contacts respectively remain electrically insulated from each other and are in electrically conductive relationship to each other, and locking means are provided for locking the switch in the second position which allows the television signal to reach the television receiver signal input terminal during authorized use of the television receiver/television set. However, the television receiver blocking mechanism is so constructed that the switch is further selectively operable to a third position in which the first and second electrical contacts remain electrically insulated from each other whereby the television signal is blocked or attenuated by the distance between the first and second electrical contacts. In this fashion, the television signal cannot reach the television receiver signal input terminal.

Preferably the television receiver signal blocking mechanism includes a box formed of at least first and second box bodies, and latch means are provided which are operable by the locking means for latching the first and second box bodies together when the switch is in the second and third positions whereby access to an interior of the box is prevented.

In further accordance with this invention, the latch means is preferably carried by the locking means and includes a rotatable plate which carries the switch, and the locking means is a manually rotatable key lock whereby rotation of the locking means imparts rotation to the plate and the switch carried thereby.

The novel television receiver signal blocking mechanism is also so constructed that the plate is formed by first and second arms with the first arm carrying the switch and a second arm defining a first latching member of a first of the box bodies. A second box body defines or carries a second latching member, and the two latching members are cooperatively latched together when the switch is in the second and third positions.

With the above and other objects in view that will hereinafter appear, the nature of the invention will be more clearly understood by reference to the following detailed description, the appended claims and the several views illustrated in the accompanying drawings.

DESCRIPTION OF THE DRAWINGS

FIG. 1 is a enlarged cross-sectional view taken generally along line 6—6 of FIG. 4, and illustrates the switch carried by the rotatable latching member in bridging electrical contact with the contactor pads of the printed circuit board.

DESCRIPTION OF THE PREFERRED EMBODIMENT

Figure 1:
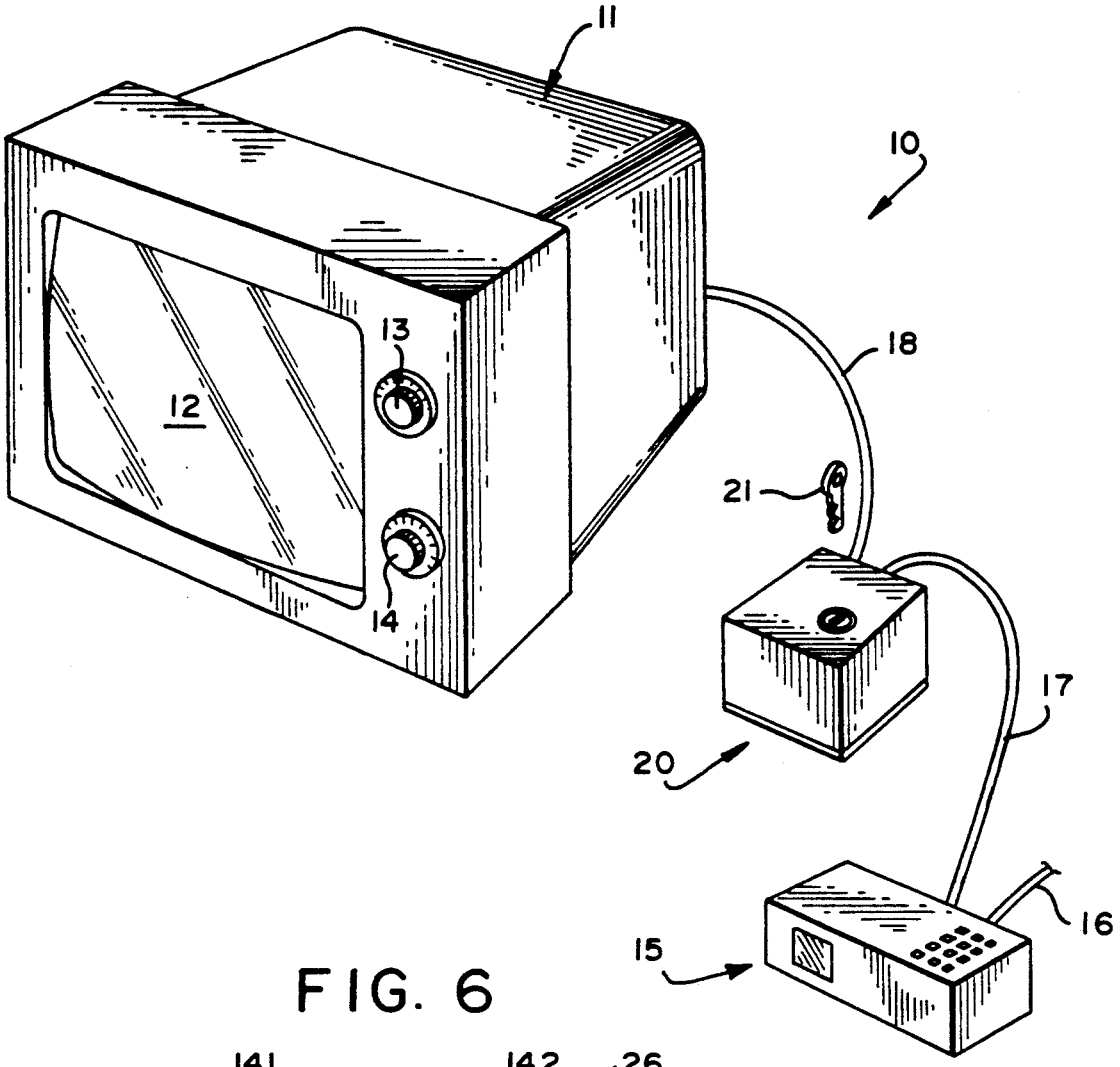
FIG. 1 is a perspective of a television receiver or television set, a television signal source, and a key operated television signal blocking mechanism connected therebetween.

A novel television receiver signal blocking system constructed in accordance with this invention is fully illustrated in FIG. 1 of the drawings and is generally designated by the reference numeral 10.

The television receiver signal blocking system 10 includes a television receiver, television set or TV having the usual screen 12, controls 13, 14, and a convention television signal receiving terminal (not shown) at the rear or back of the television receiver 11, such as a conventional exteriorly threaded male 75 ohm video cable connector.

A conventional signal source 15 includes a conventional channel selector box 15 which receives a television signal over an incoming cable or conductor 16, but this TV signal input could as well be a video cable from an outside antenna or an associated VCR, etc. However, irrespective of the source of the television signal, the television signal is connected via a first conventional shielded cable or electrical conductor 17 to a television receiver signal blocking mechanism or box 20 of the present invention which is controlled by a conventional key 21. A second conventional shielded cable or electrical conductor 18 is connected between the television receiver signal blocking mechanism 20 and the television signal receiving terminal (not shown) of the television receiver 11. Reference is made specifically to FIGS. 2 through 5 of the drawings which illustrate the various components and the functional relationship thereof of the television receiver signal blocking mechanism or box 20.

The television receiver signal blocking mechanism or box 20 (FIG. 2) includes a first, or upper box body, top cover or member 21, a second, lower box body, bottom or member 22, locking means 23, a generally L-shaped printed circuit board 24 and latching means 25 defined by a first rotatable latching member 26 and a second nonrotatable fixed latching member 27.

The first box body 21 includes a top wall 30 having a generally rectangular opening 31 formed therein. Depending from the top wall 31 are three generally cylindrical posts 32 through 34, each having a flat terminal end face 35 (FIG. 3) provided with a blind bore 36. An upper surface 37 of the printed circuit board 24 rests against the face 35 of each of the posts 32 through 34 (FIG. 3) with openings 42 through 44 of the circuit board 24 being aligned with the posts 32 through 34, respectively. A self-tapping screw 38 (FIGS. 3 through 5) passes through each of the openings 42 through 44 (FIG. 2) and is threaded in each of the blind bores 36 of each of the posts 32 through 34 to thereby secure the L-shaped printed circuit board 24 to the upper box body 21 in generally parallel relationship to the top wall 30 (See FIG. 3).

The upper box body 21 includes a first side wall 45 and a second side wall 46 each depending from the top wall 30 and being generally parallel to each other. A first end wall 47 has a relatively rectangular opening formed therein which defines a pair of opposing flanges 51, 52 (FIGS. 2, 4 and 5), each having a generally rectangular groove 53 formed therein with the grooves being in opposing relationship to each other (See FIG. 5). The first end wall 47 and the flanges 51, 52 thereof are generally in parallel relationship to a second end wall 54 which also depends from the top wall 30 (FIG. 5) and is also normal to the side walls 45, 46 (FIGS. 4 and 5).

Figure 2:
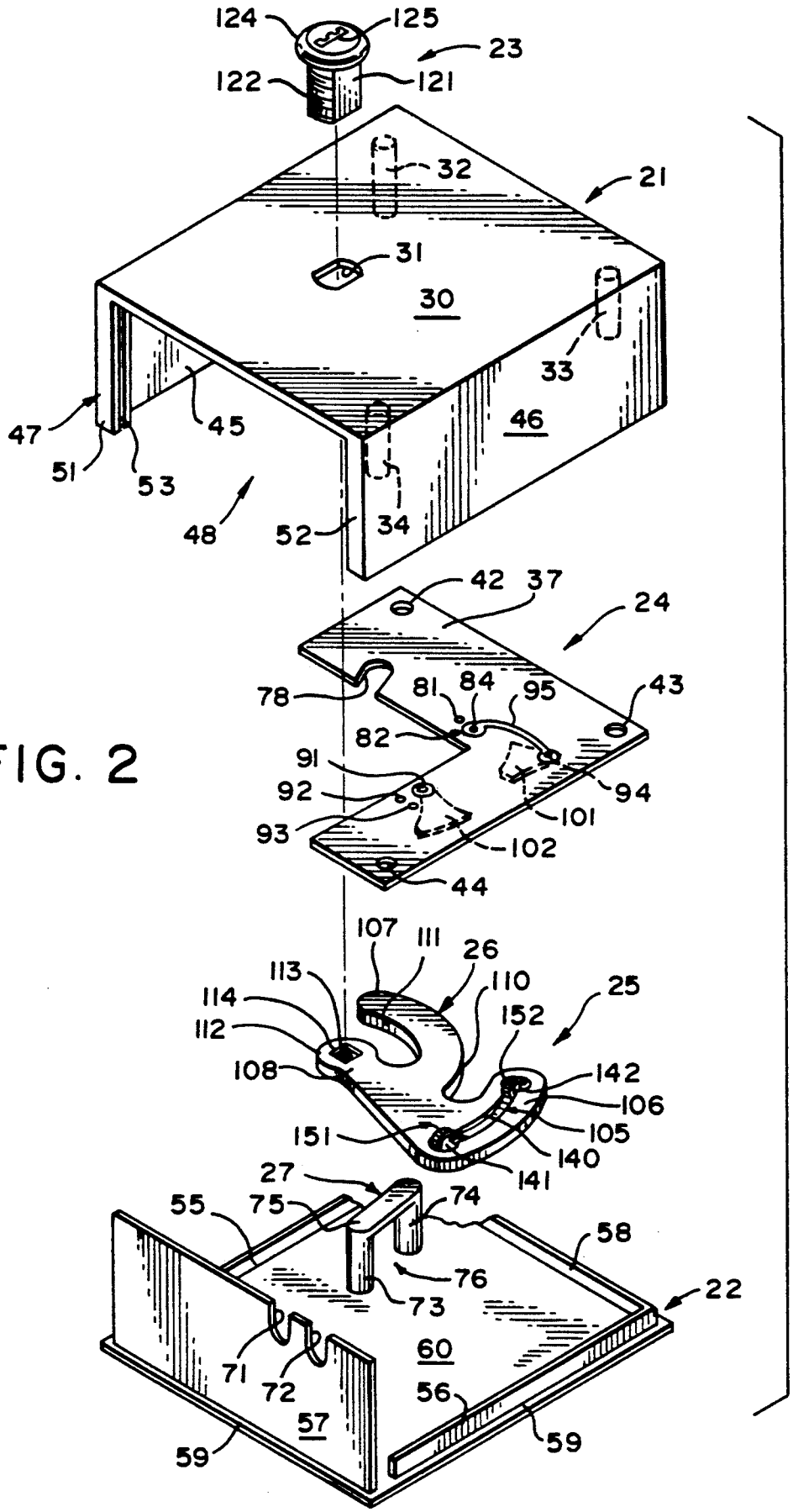
FIG. 2 is an exploded perspective view of the television receiver blocking mechanism of the invention, and illustrates a signal blocking box formed of two box bodies, a key lock, a printed circuit board, fixed and rotatable latching members, and a switch carried by the rotatable latching member which is associated with contacts of the printed circuit board.

The lower box body 22 includes a bottom wall 60 having integrally formed therewith and upstanding therefrom a first side wall 55, a second side wall 56, a first end wall 57 and a second end wall 58. The walls 55 through 58 define a generally polygonal configuration as viewed from above (FIG. 2). The exterior size and profile of the walls 55, 56 and 58 matches the interior size and profile of the walls 45, 46 and 54 of the upper box body 21 which allows lower interior surfaces (unnumbered) of the walls 45, 46 and 54 to snugly embrace the exteriors of the respective walls 55, 56, 58 of the lower box body 22. Lower edges (unnumbered) of the walls 45, 46 and 54 also rest upon a peripheral flange 59 (FIG. 2) of the lower box body 22. The first end wall 57 is of a size corresponding to the opening 48 and the depth of the grooves 53 of the flanges 51, 52 which allows the lateral edges (unnumbered) of the first end wall 57 of the lower box body 22 to be slid into and retained by the grooves 53 of the flanges 51, 52, as is apparent from FIG. 2 and illustrated in FIGS. 4 and 5. When the box bodies 21, 22 are slidably assembled together (FIGS. 3 through 5), the walls 45, 46, 54 snugly embrace the respective walls 55, 56, 58 while the edges of the end wall 57 of the lower box body 22 are slidably received and seated within the grooves 53 of the flanges 51, 52 thereby defining an interior or chamber 70 which is closed completely to the exterior except for a pair of slots 71, 72 (FIG. 2) of the end wall 57 which accommodate the respective electrical conductors or cables 17, 18 (FIGS. 4 and 5).

The second or nonrotatable latching member 27 is also carried by the bottom wall 60 (FIG. 2) of the lower box body 22, and includes two upstanding legs 73, 74 and a generally flat bridging portion or bight 75 which collectively impart a generally inverted U-shaped configuration to the nonrotatable latching member 27 and collectively define with the bottom wall an opening 76 thereof.

Figure 3:
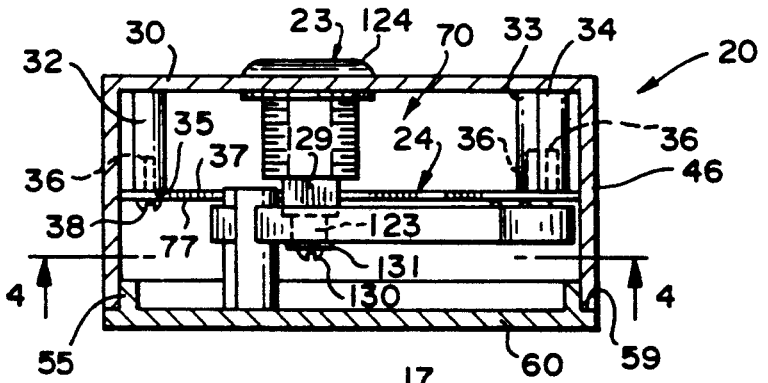
FIG. 3 is a cross-sectional view through the box defined by the assembled box bodies of FIG. 2, and illustrates the printed circuit board carried by a first or upper box body, the rotatable latching member position beneath the printed circuit board, and a portion of the rotatable latching member in latching engagement with a fixed latching member of the lower or second box body.
Figure 4:
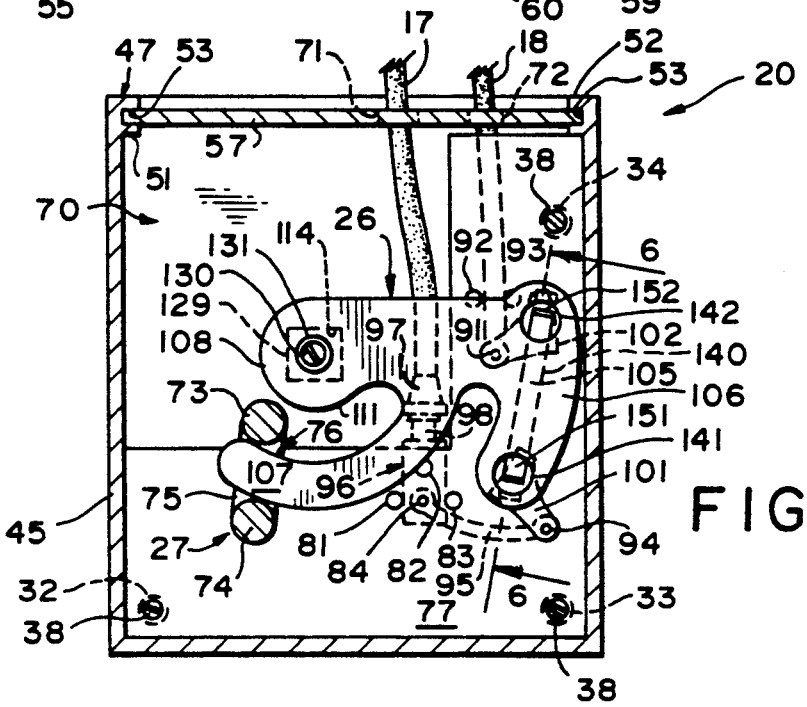
FIG. 4 is a cross-sectional view taken generally along line 4—4 of FIG. 3, and illustrates details of the rotatable and fixed latching members, spaced contactor pads of the printed circuit board, the switch carried by the rotatable latching member, and two conductors connected one to each of the television receiver and the television receiver source.
Figure 5:
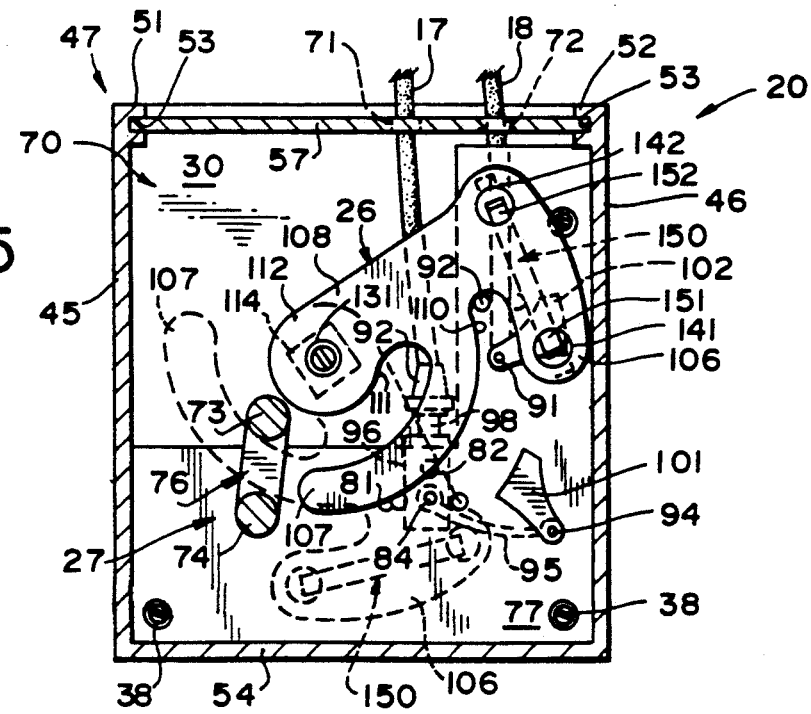
FIG. 5 is a cross-sectional view identical to FIG. 4, and illustrates the rotatable latching member in its unlatched position and in phantom outline a third position in which the latching members are still latched and in both of the solid and phantom outline positions the two spaced contactor pads of the printed circuit board are not bridged by the switch carried by the rotatable latching member thereby blocking the TV signal in both illustrated positions of the rotatable latching member.

The generally L-shaped printed circuit board 24 is constructed from electrically insulating material and in addition to the upper surface 37 includes a lower surface 77 (FIGS. 3 through 5). The printed circuit board 24 has a slot 78 formed therein to accommodate the legs 74 of the latching member 27 during the earlier described assembly of the printed circuit board 24 to the posts 32 through 34. The printed circuit board 24 also includes a first set of triangularly oriented holes or openings 81 through 83 (FIGS. 2 and 4) with a smaller hole 84 positioned between the holes 81, 83. Another set of triangularly oriented holes or openings 91 through 93 are formed through the printed circuit board 24 with the hole 91 being smaller than the holes 92, 93 (See FIG. 4). Another hole 94 is formed through the printed circuit board 24. A relatively wide (1/16") copper trace or conductor is "printed" upon the surface 37 of the printed circuit board 24 and extend between the holes or openings 84, 94.

A right-angle connector 96 is secured to the upper surface 37 of the L-shaped printed circuit board 24 by solder or fasteners associated with the openings 81 through 83. An electrical conductor (not shown) of the right-angle connector 96 is shielded/ insulated in the usual fashion and is soldered in the opening 84. The latter electrical conductor is connected to the shielded conductor or cable 17 by a conventional threaded female fitting 97 which threads upon a conventional external threaded male fitting 98 of the right-angle connector 96. In this manner, the television signal from the signal source 15 is conducted through the electrical conductor 17 to the trace or printed conductor 95.

The shielded cable 18 is similarly secured by soldering or fasteners to the upper surface 37 of the printed circuit board 24 by solder or fasteners and its shielded-/insulted axial electrical conductor (not shown) is soldered in the hole 91.

The lower surface 77 (FIGS. 4 and 5) of the printed circuit board 24 includes two "printed" copper contactor pads, contactors or contacts 101, 102 which are respectively connected by solder in the hole 94 to the trace or conductor 95 and by solder in the hole 91 to the electrical conductor (not shown) of the shielded cable or conductor 19. As is best illustrated in FIG. 2, the contactors 101, 102 are normally spaced and insulated from each other and, thus, the television signal arriving at the contactor 101 is isolated from the contactor 102 until such time as the latching member 26 is rotated to the position shown in FIG. 4 to bring switch means or metallic leaf spring switch 150 into bridging electrical contact between the contactors 101, 102, as will be described hereinafter.

The rotatable latching member 26 of the latching means 25 is a relatively flat plate of plastic or similar electrically insulating material which includes a first arm 106, a second arm 107 and a third arm 108. A generally arcuate outwardly opening slot 110 separates the arms 106, 107, while a similar outwardly opening generally arcuate slot 111 separates the arms 107, 108. A terminal end 112 of the arm 108 is somewhat rounded and includes a circular opening 113 (FIGS. 2) and a polygonal or square recess 114. The size of the recess 114 corresponds to a generally square rotatable end portion 129 (FIG. 3) of the locking means 23 which is rotatably received in a generally rectangular nonrotatable end portion 122 (FIGS. 2 and 3) having diametrically opposite threaded portions 122. The end portion 129 terminates in a cylindrical terminal end 123 which has an axial blind bore (not shown). The locking means 23 is a conventional key operated lock which has an external enlarged collar 124 and a keyhole opening 125 (FIG. 2) for the key 21 (FIG. 1). The collar 124 rests upon the top wall 30 (FIG. 3) and the entire key operated lock or locking means 23 is securely attached to the top wall 30 by a conventional nut 127 (FIG. 3) threaded upon the threaded portions 122 of the end portion 121 after the latter has been inserted through the rectangular opening 31 of the top wall 30. The portion 129 and the cylindrical terminal end 123 are rotatable relative to the end portion 121 when the key 21 is introduced into the keyhole 125 and appropriately rotated. The latter rotation is imparted to the rotatable latching member 25 through the square end portion 129 which is locked in the recess 114 by a self-tapping screw 130 which passes through a washer 131 resting against the underside (unnumbered) of the latching member 26 and is received in the axial blind bore (not shown) of the cylindrical terminal end 123.

Figure 6:
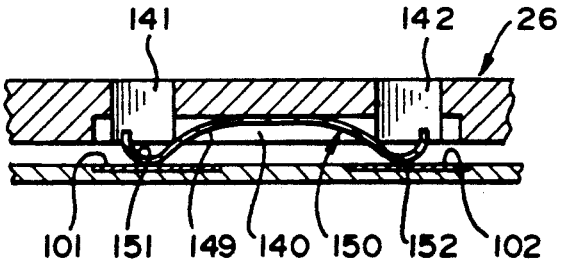
FIG. 6 which appears on the sheet of drawing containing

The first arm 106 includes a recess 140 (FIG. 6) which, ends at two relatively large circular openings 141, 142. The metallic leaf spring switch 150 is defined by a bight portion 149 (FIG. 6) and opposite terminal ends 151, 152 which open upwardly, as viewed in FIG. 6. Since the bight portion 149 lies in the slot or recess 140, the leaf spring switch 150 is confined or restrained thereby and will move with the latching member 26 as the latter is rotated during operation of the television signal blocking mechanism 20 which will now be described.

OPERATION

Reference is made to FIG. 5 of the drawings which illustrates the locking means or lock 23 in its unlocked position (in solid lines) in which the second arm 107 is aligned with the opening 76 of the nonrotatable or fixed latching member 27 but is not received or latched therein. In this position the terminal end 152 of the switch 150 is in contact only with the contactor 102 and, of course, the contactors 101, 102 are not bridged by the switch 150, as in FIGS. 4 and 6. Therefore, in the position of the latching member 26 shown in FIG. 5, the box bodies 21, 22 of the signal blocking mechanism 20 can be disassembled or reassembled, as might be necessary from time-to-time to gain access to the interior 70 for repair or similar purposes.

With the key 21 in the key slot 125, the portion 129 can be rotated to rotate the latching member 26 to the position shown in FIG. 4 and, if desired, the key 21 can be withdrawn from the key slot 125 to prevent further rotation. In this position, the terminal ends 151, 152 of the switch 150 contact the respective contactors 101, 102 bridging the same and directing the TV signal from the source 15/16 to the television signal receiving terminal (not shown) of the television receiver through the axial conductor of the cable 17, the right-angle connector 96, the solder in the hole 84, the trace or conductive strip 95, the solder in the hole 94, the contactor 101, the switch 150, the contactor 102, the solder in the hole 91, and the axial conductor of the cable 18 which is connected to the television receiver signal receiving terminal by a male fitting (not shown) corresponding to the male fitting 97. Thus, in the position of the rotatable latching member 26 illustrated in FIG. 4, the television signal will reach the television receiver 11 and, obviously, can be viewed on the screen 12 by appropriate manipulation of the controls 13, 14 and the box bodies 21, 22 are latched together by the latching means 26, 27.

If, however, one wishes to both block the video signal and maintain the box bodies 21, 22 latched together, the key 21 is rotated beyond the position shown in FIG. 4 to the phantom outline position shown in FIG. 5 in which the second arm 107 of the latching member 26 is rotated further into the opening 76 of the latching member 27 and the leaf spring switch 150 carried by the first arm 106 moves clockwise beyond both contactors 101, 102, as is clearly illustrated in FIG. 5. In the latter position, the television/video signal is blocked and/or attenuated by virtue of the insulated distance between the contactors 101, 102 and the upper and lower surface ground planes of the printed circuit board 24. After the latching member 26 is positioned in the phantom outline position shown in FIG. 5, the key 21 is withdrawn from the key slot 125, thus preventing the rotation of the portion 129 and, hence, similarly preventing rotation of the rotatable latching member 26. Obviously, the phantom outline position of the latching member 26 with the second arm 107 snugly engaged within the opening 76 and beneath the bight portion 75 prevents the box bodies 21, 22 from being disassembled. Thus, apart from totally destroying the signal blocking mechanism or box 20 to gain access to the interior 70, in the absence of the key 21 a child could not rotate the latching member 26 from the phantom outline position shown in FIG. 5, thus preventing access to the interior 70 and likewise maintaining signal blocking as aforesaid. Obviously, the key 21 need but be reinserted into the slot 125 to rotate the latching member 26 to the position shown in solid lines in FIG. 4 to permit video signal passage while preventing access to the interior 70, while further rotation of the key 21 will move the latching member 26 to the solid line position shown in FIG. 5 to permit disassembly of the blocking mechanism or box 20 as described earlier.

It was mentioned earlier that in the phantom outline position of FIG. 5 the video signal was attenuated by both the space between the contactors 101, 102 and the upper and lower surface ground planes of the printed circuit board 24. The upper and lower surface ground planes of the printed circuit board 24 are effected in a conventional manner by, for example, "printing" a conductive a layer upon the surface 37 to which the exterior of the shielded cables 17, 18 are conductively connected/grounded by the solder in the openings 81 through 83 and 92, 93. This conductive layer would, of course, be insulated from the axial conductors within the cables 17, 18, the solder in the holes 91, 84, the conductor 95 and the contactors 101, 102.

Although a preferred embodiment of the invention has been specifically illustrated and described herein, it is to be understood that minor variations may be made in the apparatus without departing from the spirit and scope of the invention, as defined the appended claims.

I claim:

1. A television receiver signal blocking system comprising a television receiver having an electrical power conductor for conducting electrical power to said television receiver, a television receiver signal blocking mechanism associated with said television receiver, said television receiver signal blocking mechanism including first and second electrical contacts normally in electrically insulated relationship to each other, a first electrical conductor for conducting a television signal being connected to said first electrical contact, a second electrical conductor being connected to said second electrical contact and to a television signal input terminal of said television receiver, switch means for selective operability between at least first and second positions in which said first and second electrical contacts respectively remain electrically insulated from each other and are in electrically conductive relationship to each other, means for locking said switch means in said first position, said television receiver signal blocking mechanism including means for supporting said locking means and said switch means, said supporting means being formed of at least first and second members, and latch means operable by said locking means for latching said first and second members together when said switch means is in said first position.

2. The television receiver signal blocking system as defined in claim 1 wherein said latch means is operable by said locking means for latching said first and second members together when said switch means is in said second position.

3. A television receiver signal blocking system comprising a television receiver having an electrical power conductor for conducting electrical power to said television receiver, a television receiver signal blocking mechanism associated with said television receiver, said television receiver signal blocking mechanism including first and second electrical contacts normally in electrically insulated relationship to each other, a first electrical conductor for conducting a television signal being connected to said first electrical contact, a second electrical conductor being connected to said second electrical contact and to a television signal input terminal of said television receiver, switch means for selective overability between at least first and second positions in which said first and second electrical contacts respectively remain electrically insulated from each other and are in electrically conductive relationship to each other, means for locking said switch means in said first position, said switch means being further selectively operable between a third position and said first and second positions in which said first and second electrical contacts remain electrically insulated from each other and the television signal is attenuated by the distance between said first and second electrical contacts, said television receiver signal blocking mechanism including a box housing said locking means and said switch, said box being formed of at least first and second members, and latch means operable by said locking means for latching said first and second members together when said switch is in said first and second positions.

4. A television receiver signal blocking system comprising a television receiver having an electrical power conductor for conducting electrical power to said television receiver, a television receiver signal blocking mechanism associated with said television receiver, said television receiver signal blocking mechanism including first and second electrical contacts normally in electrically insulated relationship to each other, a first electrical conductor for conducting a television signal being connected to said first electrical contact, a second electrical conductor being connected to said second electrical contact and to a television signal input terminal of said television receiver, switch means for selective operability between at least first and second positions in which said first and second electrical contacts respectively remain electrically insulated from each other and are in electrically conductive relationship to each other, means for locking said switch means in said first position, a plate, said plate carrying said switch means, said plate being carried by said locking means, and said locking means being a manually rotatable lock whereby rotation of said locking means imparts rotation to said plate and said switch means carried thereby.

5. The television receiver signal blocking system as defined in claim 4 wherein said plate is carried by said first body and includes first and second arms, said first arm carries said switch means, said second arm defines a first latching member of said first body, and said second body defines a second latching member which cooperatively latches with said first latching member when said switch means is in said first and third positions.

6. A television receiver signal blocking system comprising a television receiver having an electrical power conductor for conducting electrical power to said television receiver, a television receiver signal blocking mechanism associated with said television receiver, said television receiver signal blocking mechanism including first and second electrical contacts normally in electrically insulated relationship to each other, a first electrical conductor for conducting a television signal being connected to said first electrical contact, a second electrical conductor being connected to said second electrical contact and to a television signal input terminal of said television receiver, switch means for selective operability between at least first and second positions in which said first and second electrical contacts respectively remain electrically insulated from each other and are in electrically conductive relationship to each other, means for locking said switch means in said first position, said television receiver signal blocking mechanism including a member supporting said locking means and said switch means, said member being formed of at least first and second bodies, latch means operable by said locking means for latching said first and second bodies together when said switch means is in said first position whereby access to an interior of said member is prevented, a plate, said plate carries said switch means, said plate being carried by said locking means, and said locking means being a manually rotatable lock whereby rotation of said locking means imparts rotation to said plate and said switch means carried thereby.

7. The television receiver signal blocking system as defined in claim 6 wherein said plate is carried by said first body and includes first and second arms, said first arm carries said switch means, said second arm defines a first latching member of said first body, and said second body defines a second latching member which cooperatively latches with said first latching member when said switch means is in said first position.

8. A mechanism for blocking a television signal between a television signal source and a television receiver having an electrical power conductor for conducting electrical power to said television receiver comprising a box having an interior chamber, first and second electrical contacts in said chamber normally in electrical insulated relationship to each other, said first and second electrical contacts being adapted to have connected thereto respective first and second electrical conductors for respectively conducting a television signal toward and away from the respective first and second electrical contacts, switch means in said interior chamber for selective operability between at least first and second positions in which said first and second electrical contacts respectively remain electrically insulated from each other and are in electrically conductive relationship to each other, means for locking said switch means in said first position, said box including at least first and second box bodies, and latch means operable by said locking means for latching said first and second box bodies together when said switch means is in said first position whereby access to said interior chamber is prevented.

9. A mechanism for blocking a television signal between a television signal source and a television receiver having an electrical power conductor for conducting electrical power to said television receiver comprising a box having an interior chamber, first and second electrical contacts in said chamber normally in electrically insulated relationship to each other, said first and second electrical contacts being adapted to have connected thereto respective first and second electrical conductors for respectively conducting a television signal toward and away from the respective first and second electrical contacts, switch means in said interior chamber for selective operability between at least first and second positions in which said first and second electrical contacts respectively remain electrically insulated from each other and are in electrically conductive relationship to each other, means for locking said switch means in said first position, said switch means is further selectively operable between a third position and said first and second positions in which said first and second electrical contacts remain electrically insulated from each other and the television signal is attenuated by the distance between said first and second electrical contacts, said box includes at least first and second box bodies, and latch means operable by said locking means for latching said first and second box bodies together when said switch is in said first position whereby access to said interior chamber is prevented.

10. A mechanism for blocking a television signal between a television signal source and a television receiver having an electrical power conductor for conducting electrical power to said television receiver comprising a box having an interior chamber, first and second electrical contacts in said chamber normally in electrically insulated relationship to each other, said first and second electrical contacts being adapted to have connected thereto respective first and second electrical conductors for respectively conducting a television signal toward and away from the respective first and second electrical contacts, switch means in said interior chamber for selective operability between at least first and second positions in which said first and second electrical contacts respectively remain electrically insulated from each other and are in electrically conductive relationship to each other, means for locking said switch means in said first position, a plate, said plate carrying said switch means, said plate being carried by said locking means, and said locking means being a manually rotatable lock whereby rotation of said locking means imparts rotation to said plate and said switch means carried thereby.

11. The television signal blocking mechanism as defined in claim 10 wherein said box includes at least first and second box bodies, and latch means operable by said locking means for latching said first and second box bodies together when said switch means is in said first position whereby access to said interior chamber is prevented.

12. The television signal blocking mechanism as defined in claim 11 wherein said latch means includes a first latching member carried by said plate which is carried by said first box body and a second latching member carried by a second of said box bodies.

13. The television signal blocking mechanism as defined in claim 10 wherein said switch means is further selectively operable between a third position and said first and second positions in which said first and second electrical contacts remain electrically insulated from each other and the television signal is attenuated by the distance between said first and second electrical contacts.

14. The television signal blocking mechanism as defined is claim 10 wherein said switch means is further selectively operable between a third position and said first and second positions in which said first and second electrical contacts remain electrically insulated from each other and the television signal is attenuated by the distance between said first and second electrical contacts, said box includes at least first and second box bodies, and latch means operable by said locking means for latching said first and second box bodies together when said switch means is in said first position whereby access to said interior chamber is prevented.

15. The television signal blocking mechanism as defined in claim 14 wherein said latch means includes a first latching member carried by said which is carried by said first box body plate and a second latching member carried by a second of said box bodies.

16. A television receiver signal blocking system comprising a television receiver having an electrical power conductor for conducting electrical power to said television receiver, a television receiver signal blocking mechanism associated with said television receiver, said television receiver signal blocking mechanism including first and second electrical contacts normally in electrically insulated relationship to each other, a first electrical conductor for conducting a television signal being connected to said first electrical contact, a second electrical conductor being connected to said second electrical contact and to a television signal input terminal of said television receiver, switch means for selective operability between at least first and second positions in which said first and second electrical contacts respectively reman electrically insulated for each other and are in electrically conductive relationship to each other, means for locking said switch means in said first position, said switch means being further selectively operable between a third position and said first and second positions in which said first and second electrical contacts remain electrical insulated from each other and the television signal is attenuated by the distance between said first and second electrical contacts, said locking means locks said switch means in said second position but not in said third position, and said second position is located between said first and third positions.

17. A television receiver signal blocking system comprising a television receiver having an electrical power conductor for conducting electrical power to said television receiver, a television receiver signal blocking mechanism associated with said television receiver, said television receiver signal blocking mechanism including first and second electrical contacts normally in electrically insulated relationship to each other, a first electrical conductor for conducting a television signal being connected to said first electrical contact, a second electrical conductor being connected to said second electrical contact and to a television signal input terminal of said television receiver, switch means for selective operability between at least first and second positions in which said first and second electrical contacts respectively remain electrically insulated from each other and are in electrically conductive relationship to each other, means for locking said switch means in said first position, said switch means being further selectively operable between a third position and said first and second positions in which said first and second electrical contacts remain electrically insulated from each other and the television signal is attenuated by the distance between said first and second electrical contacts, and said second position is located between said first and third positions.

18. A television receiver signal blocking system comprising a television receiver having an electrical power conductor for conducting electrical power to said television receiver, a television receiver signal blocking mechanism associated with said television receiver, said television receiver signal blocking mechanism including first and second electrical contacts normally in electrically insulated relationship to each other, a first electrical conductor for conducting a television signal being connected to said first electrical contact, a second electrical conductor being connected to said second electrical contact and to a television signal input terminal of said television receiver; switch means for selective operability between at least first, second and third positions in which said first and second electrical contacts respectively remain electrically insulated from each other, arm in electrically conductive relationship to each other, and are electrically insulated from each other but attenuate the television signal by the distance between said first and second electrical contacts; and means for locking said switch means in said first and second positions but unlocking said switch means in said third position.

19. The television receiver signal blocking system as defined in claim 18 wherein said second position is located between said first and third positions.

* * * * *